US011181840B2

(12) United States Patent
Nagata et al.

(10) Patent No.: US 11,181,840 B2
(45) Date of Patent: Nov. 23, 2021

(54) TONER

(71) Applicant: CANON KABUSHIKI KAISHA, Tokyo (JP)

(72) Inventors: Ryo Nagata, Tokyo (JP); Kosuke Fukudome, Tokyo (JP); Tetsuya Kinumatsu, Mishima (JP); Tomohiro Unno, Numazu (JP); Mariko Yamashita, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/864,341

(22) Filed: May 1, 2020

(65) Prior Publication Data

US 2020/0363745 A1 Nov. 19, 2020

(30) Foreign Application Priority Data

May 13, 2019 (JP) ..... JP2019-090557

(51) Int. Cl.

| | |
|---|---|
| ***G03G 9/08*** | (2006.01) |
| ***G03G 9/083*** | (2006.01) |
| ***G03G 9/087*** | (2006.01) |

(52) U.S. Cl.

CPC ..... *G03G 9/0833* (2013.01); *G03G 9/0819* (2013.01); *G03G 9/0821* (2013.01); *G03G 9/08711* (2013.01); *G03G 9/08755* (2013.01)

(58) Field of Classification Search

CPC ... G03G 9/0833; G03G 9/0821; G03G 9/0819
USPC ..... 430/106.1, 111.4
See application file for complete search history.

(56) References Cited

U.S. PATENT DOCUMENTS

| | | | |
|---|---|---|---|
| 8,603,712 | B2 | 12/2013 | Aoki et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 9,034,549 | B2 | 5/2015 | Shiotari et al. |
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |

(Continued)

FOREIGN PATENT DOCUMENTS

| | | |
|---|---|---|
| JP | 2008-015232 | 1/2008 |
| JP | 2017-102398 | 6/2017 |

OTHER PUBLICATIONS

U.S. Appl. No. 16/864,273, Mariko Yamashita, filed May 1, 2020.

(Continued)

*Primary Examiner* — Mark A Chapman
(74) *Attorney, Agent, or Firm* — Venable LLP

(57) ABSTRACT

A toner comprising a toner particle including a binder resin and a magnetic body, wherein in cross-sectional observation of the toner with a transmission electron microscope, where an area percentage occupied by the magnetic body in a region of 200 nm or less from a contour of a cross section of the toner particle to a centroid of the cross section is taken as A1, and an area percentage occupied by the magnetic body in a region of from 200 nm to 400 nm from the contour of the cross section of the toner particle to the centroid of the cross section is taken as A2, the area percentage A1 is from 38% to 85%, the area percentage A2 is from 0% to 37%, and a ratio A2/A1 of the area percentage A2 to the area percentage A1 is from 0 to 0.75.

13 Claims, 3 Drawing Sheets

(56) References Cited

U.S. PATENT DOCUMENTS

| | | | |
|---|---|---|---|
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,857,713 | B2 | 1/2018 | Kosaki et al. |
| 9,869,943 | B2 | 1/2018 | Aoki et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 10,578,990 | B2 | 3/2020 | Tsuda et al. |
| 2019/0041762 | A1 | 2/2019 | Yoshiba et al. |
| 2019/0332027 | A1 | 10/2019 | Kenmoku et al. |
| 2020/0103774 | A1 | 4/2020 | Fukudome et al. |
| 2020/0103776 | A1 | 4/2020 | Kinumatsu et al. |
| 2020/0166861 | A1 | 5/2020 | Uratani et al. |
| 2020/0183293 | A1 | 6/2020 | Kinumatsu et al. |
| 2020/0183294 | A1 | 6/2020 | Fukudome et al. |
| 2020/0183296 | A1 | 6/2020 | Nishikawa et al. |

OTHER PUBLICATIONS

U.S. Appl. No. 16/908,857, Tomohiro Unno, filed Jun. 23, 2020.

U.S. Appl. No. 16/908,885, Tetsuya Kinumatsu, filed Jun. 23, 2020.

TONER

BACKGROUND OF THE INVENTION

Field of the Invention

The present invention relates to a toner suitable for an image forming method such as an electrophotographic method.

Description of the Related Art

In recent years, increase in speed, extension of service life, energy saving, and downsizing have been required for electrophotographic image forming apparatuses such as copiers and printers, and to meet these demands, further improvement of various types of performance is needed for toners. In particular, from the viewpoint of extending the service life, further improvement in quality stability is required for toners. In order to extend the service life, it is important that the quality does not significantly change even during long-term durability use.

Meanwhile, further energy saving is required, and in particular, improvement of low-temperature fixing performance is urgently required for toners.

However, improvement in quality stability performance during long-term durability use and improvement in low-temperature fixing performance tend to be in a trade-off relationship. A method of adding silica fine particles having a large number-average particle diameter or silica fine particles of irregular shape, and a method of covering the toner particle surface with a hard surface layer are used for improving the quality stability performance during long-term durability use. However, these methods sometimes hinder the spread of the toner on the paper and reduce the low-temperature fixing performance. In particular, since the low-temperature fixing performance of a monochrome toner is greatly affected by the spread of the toner on the paper, it has been a difficult task to improve the quality stability performance during long-term durability use without hindering the low-temperature fixing performance of the toner.

For this reason, Japanese Patent Application Publication Nos. 2008-15232 and 2017-102398 propose a toner in which a material for improving low-temperature fixing performance such as a crystalline polyester is used inside a toner, wherein a magnetic body is unevenly distributed near the toner particle surface thereby achieving both low-temperature fixing performance and quality stability performance during long-term durability use.

SUMMARY OF THE INVENTION

However, even in the method disclosed in the above-mentioned patent literature, the low-temperature fixing performance and the quality stability performance during long-term durability use are insufficient. In particular, it has been found that there is still room for study on the state of presence of magnetic bodies, and that further improvement is necessary.

An object of the present invention is to provide a toner for which the above-mentioned problems have been solved. Specifically, it is an object of the present invention to prevent the hindrance to the low-temperature fixing performance of a toner using magnetic bodies, and to prevent image defects such as fogging during long-term use in a severe environment.

A toner comprising a toner particle including a binder resin and a magnetic body, wherein in cross-sectional observation of the toner with a transmission electron microscope, where an area percentage occupied by the magnetic body in a region of 200 nm or less from a contour of a cross section of the toner particle to a centroid of the cross section is taken as A1, and an area percentage occupied by the magnetic body in a region of from 200 nm to 400 nm from the contour of the cross section of the toner particle to the centroid of the cross section is taken as A2, the area percentage A1 is from 38% to 85%, the area percentage A2 is from 0% to 37%, and a ratio A2/A1 of the area percentage A2 to the area percentage A1 is from 0 to 0.75.

According to the present invention, it is possible to obtain a toner using magnetic bodies in which the hindrance to the low-temperature fixing performance can be prevented, and image defects such as fogging during long-term use in a severe environment can be also prevented.

Further features of the present invention will become apparent from the following description of exemplary embodiments with reference to the attached drawings.

DESCRIPTION OF THE EMBODIMENTS

Figure 1:
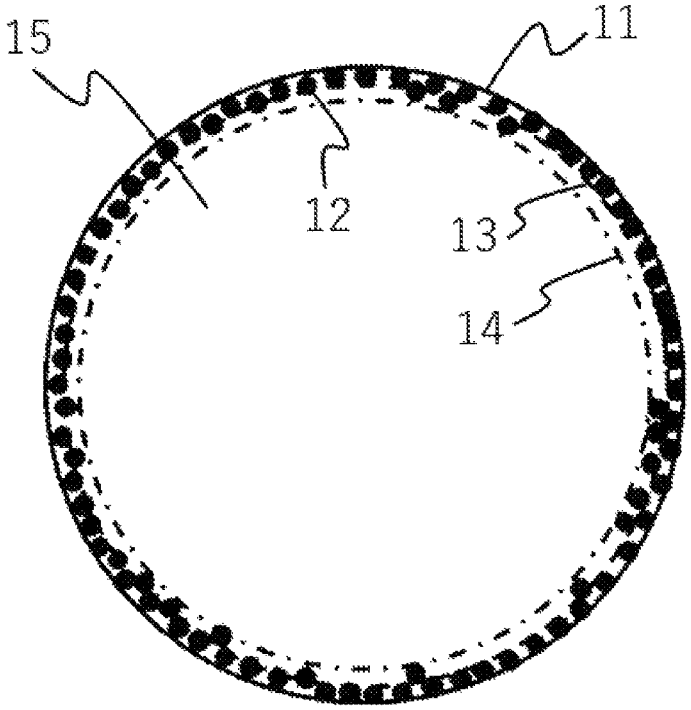
FIG. 1 is an example of a schematic diagram showing the state of presence of magnetic bodies inside a toner.

The description of "from XX to YY" or "XX to YY" representing a numerical range means a numerical range including a lower limit and an upper limit which are end-points unless otherwise specified.

As described above, for example, a toner in which magnetic bodies are unevenly distributed near the surface of toner particle has been proposed as a method for achieving both low-temperature fixing performance and quality stability performance during long-term durability use.

However, according to the study conducted by the present inventors, it is difficult to improve the fixing performance by using the above-described method alone when paper having large irregularities such as rough paper is used in combination with high-speed and light-pressure fixing means.

It was revealed that this is because pressure and heat are not easily transmitted to the toner in the concave portion of the paper in the fixing nip, and the deformation and melt-spreading of the toner in the concave portion of the paper in the fixing nip are prevented, so that adhesion between the paper and the toner is reduced.

For this reason, where the density of magnetic bodies near the toner particle surface is increased in the above-described manner, in the concave portion of the paper, the melt-spreading of the toner is hindered, and it is difficult to achieve both the durability and the low-temperature fixability.

Furthermore, according to the study conducted by the present inventors, it has been found that it is difficult to improve the quality stability performance during long-term durability use in a severe environment by only the above-mentioned method.

This is because, in the above-described method, the regions where the magnetic bodies are present at a high density are widely distributed in the thickness direction of the toner, and at some locations, it is difficult to obtain the effect of improving the hardness by the magnetic bodies. As a result, when particles of a toner with improved low-temperature fixing performance are repeatedly rubbed against each other or against a member in the developing unit in a severe environment, that is, a high-temperature environment, an external additive present on the surface of the toner particle is embedded in the toner particle.

The toner particle in which the external additive is embedded is more frequently in contact with other toner particles or the external additive, the flowability of the toner is decreased, and image quality is degraded due to insufficient charging, that is, image defects such as fogging occur.

As a result of intensive studies conducted in consideration of these phenomena, the present inventors came up with an idea that in order to solve the above two problems at the same time, it is necessary that the magnetic bodies be densely present within a specific distance range from the contour of the cross section of the toner particle and be sparsely present further inside.

Further, based on the results of intensive studies, the present inventors have found that both low-temperature fixability and quality stability can be achieved by arranging a layer having a responsiveness to an external force (hereinafter referred to as a "response layer") near the surface of the toner particle, and arranging an easily melt-spreadable layer (hereinafter referred to as a "molten layer") in a layer below the response layer.

The present inventors consider this effect as follows.

First, the response layer will be described. As a result of rubbing between the toner particles or between the toner particle and a member in the developing unit, an external force is applied to the external additive fixedly attached to the surface of the toner particle in the direction toward the inside of the toner particle and attempts to push the external additive inward. However, where magnetic bodies are disposed at a high density near the surface of the toner particle, the stress transmitted to the toner particle by the external additive is propagated and reflected by the magnetic bodies.

Therefore, the toner particle is quasi-hardened against the embedding of the external additive, and the embedding of the external additive is prevented. This effect is also exhibited when the magnetic bodies are not present directly under the external additive. This is because the stress transmitted from the external additive to the toner particle spreads radially, and therefore, where the density of the magnetic bodies is higher than a certain value, the surrounding magnetic bodies receive the reflection of the stress and the embedding prevention effect such as described hereinabove can be obtained.

Next, the molten layer will be described. The fixing performance of the toner to paper depends on the degree of melt-spreading in the paper. In particular, when the nip time in the fixing process is short on paper with large unevenness such as rough paper, the melt-spreading when no pressure is applied is a dominant factor. Further, it is considered that this effect depends on the melt-spreading performance at sites present at a distance of about 400 nm from the surface of the toner particle.

Therefore, improving the melt-spreading performance at such sites leads to improving the low-temperature fixability described above. However, there is a concern that the above-described response layer may hinder the melt-spreading of the toner when no pressure is applied. For this reason, it is necessary to improve the melt-spreading in a region on the inner side with respect to the response layer and at sites corresponding to a distance of about 400 nm from the surface of the toner particles. A conceivable method to attain this object involves making the magnetic body density equal to or below a certain value in a region on the inner side with respect to the response layer (magnetic body layer) and in a region (molten layer) up to 400 nm from the toner particle surface, which makes it possible to improve the melt-spreading of the toner when no pressure is applied.

As a result of intensive studies conducted in consideration of these phenomena, the present inventors have found that the above two problems can be solved at the same time by forming a magnetic body layer in which magnetic bodies are present at a high density within a specific distance range from the contour of cross section of the toner particle and by sparsely arranging the magnetic bodies on the inner side with respect to the magnetic body layer, and have arrived at the present invention.

That is the invention relates to a toner comprising a toner particle including a binder resin and a magnetic body, wherein in cross-sectional observation of the toner with a transmission electron microscope, where an area percentage occupied by the magnetic body in a region of 200 nm or less from a contour of a cross section of the toner particle to a centroid of the cross section is taken as A1, and an area percentage occupied by the magnetic body in a region of from 200 nm to 400 nm from the contour of the cross section of the toner particle to the centroid of the cross section is taken as A2, the area percentage A1 is from 38% to 85%, the area percentage A2 is from 0% to 37%, and a ratio A2/A1 of the area percentage A2 to the area percentage A1 is from 0 to 0.75.

The presence state of the magnetic bodies inside the toner particle is observed using a TEM after processing the toner particle into slices. In the cross-sectional image of the toner obtained by TEM observation, a region (response layer) of 200 nm or less from the contour of the cross section of the toner particle to the centroid of the cross section is a range obtained as follows.

That is, the length per unit pixel is calculated from the magnification and resolution of the TEM, and the number of pixels corresponding to 200 nm is calculated based thereon. Next, a boundary line is drawn at a distance of the number of pixels corresponding to 200 nm from the contour of the cross section of the toner particle in the direction toward the centroid of the cross section. A region from the boundary line to the toner particle surface is defined as a region (hereinafter, referred to as a region A) of 200 nm or less from the contour of the cross section of the toner particle to the centroid of the cross section.

A region (molten layer, hereinafter referred to as region B) of from 200 nm to 400 nm from the contour of the cross section of the toner particle in the direction of the centroid of the cross section (see FIG. 1) is similarly determined. The detailed procedure will be described later.

The symbols in FIG. 1 are as follows.

11: toner particle surface (contour line), 12: magnetic body, 13: (dashed line) boundary line at a position of 200 nm from the contour to the centroid, 14: (alternate long and short dash line) boundary line at a position of 400 nm from the contour to the centroid, 15: inside the toner particle.

Where the area percentage of the magnetic body in the area of the region A is taken as A1, the value of A1 needs to be from 38% to 85%, and preferably from 45% to 85%.

When the area percentage A1 is 38% or more, the magnetic bodies located in the vicinity of the surface of the toner particle are distributed within an appropriate distance, and are present at a very short distance from the surface. Therefore, the vicinity of the toner particle surface is pseudo-hardened by the effect of stress propagation against the force trying to embed the external additive (see FIG. 2).

As a result, the external additive present on the toner particle surface has a higher resistance to embedding due to rubbing between the toner particles and between the toner particle and the member during long-term durability use, and the embedding of the external additive can be prevented. This effect occurs only when the external additive receives an external force. That is, this effect occurs only when rubbing occurs between the toner particles and between the toner particle and the member, so that it is possible to select a toner material that emphasizes the fixing performance.

Meanwhile, where the value of A1 is less than 38%, the distance between the magnetic bodies present in the region A is large, and the effect of preventing the embedding which is demonstrated due to the propagation of the stress to the magnetic bodies cannot be obtained, and fogging is likely to occur during long-term durability use in a severe environment.

Further, where the value of A1 exceeds 85%, almost no resin component such as a binder resin is present in the vicinity of the surface of the toner particle, so that the contact point between the paper and the toner becomes a magnetic body, and the melt-spreading of the toner on the paper is hindered.

Figure 2:
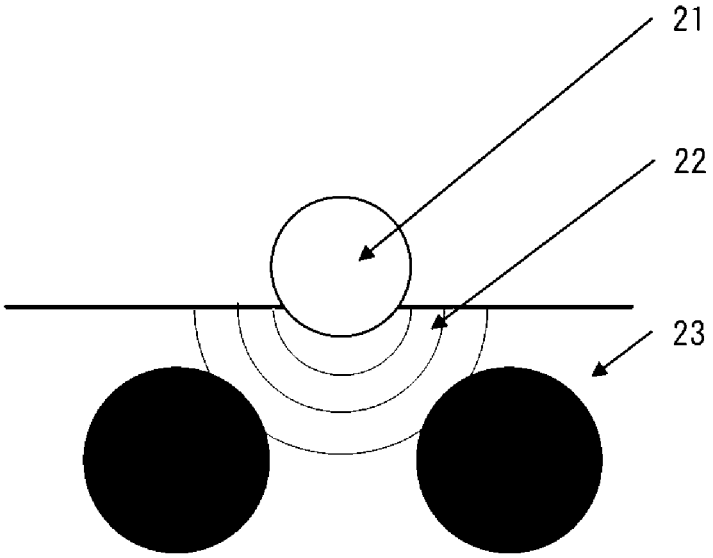
FIG. 2 is an image diagram of stress propagation by magnetic body.

The symbols in FIG. 2 are as follows.

21: external additive, 22: image of transmitted stress range, 23: magnetic body Where the area percentage of the magnetic bodies in the area of the region B is defined as A2, the value of A2 needs to be from 0% to 37%, and preferably from 0% to 29%.

Where the area percentage A2 is 37% or less, the amount of magnetic bodies present in the region B is small, and the viscosity of the region B at the time of fixing can be reduced. For this reason, the viscosity at the time of fixing in the combined region of the regions A and B is reduced, and the melt-spreading on the paper can be improved.

Meanwhile, where A2 exceeds 37%, the amount of magnetic bodies present in the region B is large and the density is high, so that the viscosity at the time of fixing in the combined region of the regions A and B is increased. For this reason, the toner is unlikely to melt-spread on the paper.

Further, the value of the ratio (A2/A1) of the area percentage A2 to the area percentage A1 needs to be from 0 to 0.75, and preferably from 0 to 0.60.

Where A2/A1 is 0.75 or less, it is possible to achieve both the effect of stress propagation in the region A and the effect of improving the melt-spreading in the region B. Meanwhile, where the value of A2/A1 is larger than 0.75, the amount of magnetic bodies present in the region including the region A and the region B is increased with respect to the amount of magnetic bodies present in the region A. As a result, the viscosity near the toner particle surface in the fixing nip increases, and the melt-spreading of the toner is hindered.

Where the area percentage occupied by the magnetic bodies in a region (region on the inner side of the region B) of 400 nm or more from the contour of the toner particle cross section to the centroid of the cross section is taken as A3, the area percentage A3 is preferably 10% or less, and more preferably 5% or less. When the area percentage is 10% or less, when the toner is deformed by receiving heat and pressure in the fixing nip, the toner is easily deformed, and the fixing performance can be further improved. The lower limit is not particularly limited, but is preferably 0% or more.

The number-average particle diameter D1 of the toner is preferably from 4.0 μm to 10.0 μm, and more preferably from 4.0 μm to 9.0 μm.

Within this range, viscous deformation due to the interfacial tension of the toner present in the recessed of the paper becomes a main phenomenon, and the aforementioned effect of improving the fixing performance by the value of A2 can be improved.

The binder resin is not particularly limited, and a known resin for toner can be used. Further, the binder resin preferably includes the resin B as a main component, and more preferably, the binder resin is the resin B. For example, the amount of the resin B in the binder resin is preferably from 50% by mass to 100% by mass, more preferably from 80% by mass to 100% by mass, and even more preferably from 90% by mass to 100% by mass.

A vinyl resin is a specific example of the resin B.

The following monomers can be used in the production of the vinyl resin.

Aliphatic vinyl hydrocarbons: alkenes, for example, ethylene, propylene, butene, isobutylene, pentene, heptene, diisobutylene, octene, dodecene, octadecene, and other α-olefins; alkadienes, for example, butadiene, isoprene, 1,4-pentadiene, 1,6-hexadiene, and 1,7-octadiene.

Alicyclic vinyl hydrocarbons: mono- or di-cycloalkenes and alkadienes, for example, cyclohexene, cyclopentadiene, vinylcyclohexene, ethylidene bicycloheptene; terpenes, for example, pinene, limonene, and indene.

Aromatic vinyl hydrocarbons: styrene and hydrocarbyl (alkyl, cycloalkyl, aralkyl and/or alkenyl) substituents thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxy group-including vinyl monomers and metal salts thereof: unsaturated monocarboxylic acids having from 3 to 30 carbon atoms, unsaturated dicarboxylic acids, anhydrides thereof and monoalkyl (from 1 to 27 carbon atoms) esters thereof. For example, acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoethers of itaconic acid, citraconic acid, monoalkyl esters of citraconic acid, and carboxy group-including vinyl monomers of cinnamic acid.

Vinyl esters, for example, vinyl acetate, vinyl butyrate, vinyl propionate, vinyl butyrate, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl α-ethoxy acrylate, alkyl acrylates and alkyl methacrylates having an alkyl group (linear or branched) having from 1 to 22 carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (dialkyl esters of fumaric acid, the two alkyl groups are each independently a linear, branched or alicyclic group having from 2 to 8 carbon atoms), dialkyl maleates (dialkyl esters of maleic acid, the two alkyl groups are each independently a linear, branched or alicyclic group having from 2 to 8 carbon atoms), polyallyloxyalkanes (diallyloxyethane, triallyloxyethane, tetraallyloxyethane, tetraallyloxypropane, tetraallyloxybutane, and tetramethallyloxyethane), vinyl monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter abbreviated as EO) 10 mol adduct acrylate, methyl alcohol ethylene oxide 10 mol adduct methacrylate, lauryl alcohol EO 30 mol adduct acrylate, and lauryl alcohol EO 30 mol adduct methacrylate), polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-including vinyl esters: for example, carboxyalkyl acrylates having an alkyl chain having from 3 to 20 carbon atoms, and carboxyalkyl methacrylates having an alkyl chain having from 3 to 20 carbon atoms.

Among them, a copolymer of an aromatic vinyl hydrocarbon and a vinyl ester is preferable, and it is more preferable that the resin B includes a styrene acrylic resin. The styrene acrylic resin is preferably a copolymer of at least one selected from the group consisting of alkyl acrylates and alkyl methacrylates having an alkyl group (linear or branched) having from 1 to 22 carbon atoms, and styrene.

The toner particle includes magnetic bodies.

Examples of the magnetic bodies include magnetic iron oxides such as magnetite, maghemite, and ferrite, and magnetic iron oxides including other metal oxides; metals such as Fe, Co, and Ni, or alloys of these metals and metals such as Al, Co, Cu, Pb, Mg, Ni, Sn, Zn, Sb, Be, Bi, Cd, Ca, Mn, Se, Ti, W, V, and mixtures thereof.

Among them, magnetite is preferable, and the shape thereof may be polyhedron, octahedron, hexahedron, sphere, needle, flake, and the like. From the viewpoint of increasing the image density, the shape with small anisotropy, such as polyhedron, octahedron, hexahedron, and sphere is preferable.

The number-average particle diameter of primary particles of the magnetic bodies is preferably from 100 nm to 300 nm, and more preferably from 150 nm to 250 nm.

The number-average particle diameter of primary particles of the magnetic bodies present in the toner particle can be measured using a transmission electron microscope.

Specifically, after the toner to be observed is sufficiently dispersed in an epoxy resin, the toner is cured in an atmosphere at a temperature of 40° C. for 2 days to obtain a cured product. The cured product is used as a flaky sample obtained with a microtome, an image with a magnification of from 10,000 to 40,000 times is captured with a transmission electron microscope (hereinafter also referred to as a TEM), and the projected area of primary particles of 100 magnetic bodies in the image is measured. The equivalent diameter of a circle equal to the projected area is defined as a particle diameter of the primary particle of the magnetic body, and the average value of the 100 particles is defined as the number-average particle diameter of the primary particles of the magnetic bodies.

The amount of the magnetic bodies is preferably from 40 parts by mass to 180 parts by mass based on 100 parts by mass of the binder resin. When the amount of the magnetic bodies is in the above range, the area percentages A1 and A2 can be easily controlled.

The amount of the magnetic bodies in the toner can be measured using a thermal analyzer TGA Q5000IR manufactured by Perkin Elmer Corp. In the measurement, a toner is heated from normal temperature to 900° C. at a temperature rise rate of 25° C./min in a nitrogen atmosphere, the mass loss from 100° C. to 750° C. is taken as the mass of the components after excluding the magnetic bodies from the toner, and the remaining mass is taken as the mass of the magnetic bodes.

The following can be exemplified as a method for manufacturing the magnetic bodies.

An alkali such as sodium hydroxide is added to the aqueous ferrous salt solution in an amount equivalent to or more than the iron component to prepare an aqueous solution including ferrous hydroxide. Air is blown while maintaining the pH of the prepared aqueous solution at pH 7 or more, and an oxidation reaction of ferrous hydroxide is performed while heating the aqueous solution to 70° C. or more, to generate seed crystals serving as cores of the magnetic bodies.

Next, an aqueous solution including one equivalent of ferrous sulfate based on the amount of the alkali previously added is added to the slurry-like liquid including the seed crystals. The reaction of ferrous hydroxide is advanced while blowing air while maintaining the pH of the liquid at 5 to 10, and magnetic iron oxide particles are grown with the seed crystals as cores. At this time, the shape and magnetic properties of the magnetic bodies can be controlled by selecting arbitrary pH, reaction temperature, and stirring conditions. As the oxidation reaction proceeds, the pH of the liquid shifts to the acidic side, but it is preferable that the pH of the liquid be not less than 5. The magnetic body can be obtained by filtering, washing and drying the obtained magnetic iron oxide particles by a conventional method.

The magnetic body is preferably a hydrophobed magnetic body A which has been hydrophobed using an alkyl trialkoxysilane coupling agent represented by the following formula (I) as a hydrophobic treatment agent. The hydrophobed magnetic body A has a magnetic body and a hydrophobic treatment agent on the surface of the magnetic body.

$$C_pH_{2p+1}—Si—(OC_qH_{2q+1})_3 \quad (I)$$

In the formula (I), p represents an integer of from 4 to 16, and q represents an integer of from 1 to 3.

It is preferable that p in the above formula be 4 or more, because sufficient hydrophobicity can be imparted. Meanwhile, it is preferable that p be 16 or less, because treatment can be uniformly performed on the surface of the magnetic body, and coalescence of the magnetic bodies can be prevented.

The amount of the hydrophobic treatment agent added is preferably from 0.3 parts by mass to 2.0 parts by mass, more preferably 1.5 parts by mass or less, and even more preferably 1.3 parts by mass or less based on 100 parts by mass of the untreated magnetic bodies.

When using the above silane coupling agents, the treatment can be performed with a single agent or with a combination of a plurality thereof. When using a plurality of agents in combination, the treatment may be performed individually with each coupling agent, or simultaneously. In addition, a titanium coupling agent or the like may be used in combination.

The method of the hydrophobic treatment is not particularly limited, but the following method is preferred.

For the purpose of uniformly reacting the hydrophobic treatment agent on the particle surface of the magnetic body to express high hydrophobicity, and at the same time, partially leaving the hydroxyl groups on the particle surface of the magnetic body without complete hydrophobization, it is preferable that the surface treatment be performed in a dry manner using a wheel-type kneader or a grinder.

Here, a Mix-Muller, a Multi-Mul, a Stotts mill, a backflow kneader, an Erich-mill, or the like can be adopted as the wheel-type kneader, and it is preferable to use the Mix-Muller.

When a wheel-type kneader or a grinder is used, three functions of a compression action, a shearing action, and a spatula action can be exhibited.

The hydrophobic treatment agent present between the particles of the magnetic bodies is pressed against the surface of the magnetic bodies by the compression action, so that the adhesion and the reactivity with the particle surface can be enhanced. By applying a shear force to each of the hydrophobic treatment agent and the magnetic body by a shearing action, the hydrophobic treatment agent can be stretched and the particles of the magnetic body can be broken apart to release aggregates. Further, with the spatula action, the hydrophobic treatment agent present on the surface of the magnetic body particles can be spread evenly as if by a spatula.

As a result of continuously and repeatedly demonstrating the above three actions, the surface of each magnetic body particle can be uniformly treated while breaking apart the particle aggregates and separating into individual particles without re-aggregation.

Usually, the hydrophobic treatment agent represented by the formula (I) and having a relatively large number of carbon atoms is unlikely to treat the particle surface of the magnetic body uniformly at the molecular level because the molecule of the agent is large and bulky, but the treatment by the above method is preferable because the treatment can be performed stably.

When the surface treatment of the magnetic body is performed by a wheel-type kneader or a grinder by using a hydrophobic treatment agent represented by the formula (I), the particle surface of the magnetic body on which portions that have reacted with the hydrophobic treatment agent and hydroxyl groups that remained unreacted are alternately present and co-present can be achieved.

By setting the particle surface of the magnetic body in such a state, it is possible to impart a certain water absorbing property while increasing the hydrophobicity, and it is possible to control the polarity of the magnetic body.

The toner particle preferably includes the resin C.

The resin C is preferably an amorphous polyester.

The amount of the resin C is preferably from 1 part by mass to 50 parts by mass, more preferably from 1 part by mass to 20 parts by mass, and even more preferably from 2 parts by mass to 10 parts by mass with respect to 100 parts by mass of the binder resin.

Known monomers can be used for the production of the amorphous polyester resin. For example, a divalent, trivalent or higher carboxylic acid and a dihydric, trihydric or higher alcohol can be used. Specific examples of these monomers are listed hereinbelow.

Examples of divalent carboxylic acids include dibasic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, and dodecenyl succinic acid, anhydrides thereof or lower alkyl esters thereof, and aliphatic unsaturated dicarboxylic acids such as maleic acid, fumaric acid, itaconic acid, citraconic acid, and the like. Lower alkyl esters and acid anhydrides of these dicarboxylic acids can also be used.

Examples of the trivalent or higher carboxylic acid include 1,2,4-benzenetricarboxylic acid, 1,2,5-benzenetricarboxylic acid, anhydrides thereof, lower alkyl esters thereof, and the like.

These may be used alone or in combination of two or more.

Examples of the dihydric alcohols include alkylene glycols (1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediols, and 1,20-icosanediol); alkylene ether glycols (polyethylene glycol and polypropylene glycol); alicyclic diols (1,4-cyclohexanedimethanol); bisphenols (bisphenol A); alkylene oxide (ethylene oxide and propylene oxide) adducts of alicyclic diols, and alkylene oxides (ethylene oxide and propylene oxide) adducts of bisphenols (alkylene oxide adducts of bisphenol A).

The alkyl segment of the alkylene glycol and the alkylene ether glycol may be linear or branched. An alkylene glycol having a branched structure can also be preferably used.

Also, an aliphatic diol having a double bond can be used. Examples of the aliphatic diol having a double bond include the following compounds.

2-Butene-1,4-diol, 3-hexene-1,6-diol, and 4-octene-1,8-diol.

Also, examples of the trivalent or higher alcohol include glycerin, trimethylolethane, trimethylolpropane, pentaerythritol, and the like.

These may be used alone or in combination of two or more.

A monovalent acid such as acetic acid, benzoic acid, and the like, and a monohydric alcohol such as cyclohexanol, benzyl alcohol, and the like can be used as needed for the purpose of adjusting the acid value and the hydroxyl value.

It is preferable that the alcohol component such as bisphenols.

Further, it is preferable that the amorphous polyester have a structure in which isosorbide is condensed. The structure in which isosorbide is condensed is represented by the following formula (A). Where the amorphous polyester includes such a structure, it is possible to arrange more magnetic bodies uniformly in the region A. It is assumed that such an effect is produced because by including a structure in which isosorbide is condensed, the relationship between the magnetic body, the binder resin, and the resin C is easily maintained properly.

The amorphous polyester is prepared, for example, by condensing a divalent carboxylic acid or an anhydride thereof with isosorbide and a dihydric alcohol. Specifically, the amorphous polyester can be prepared by a dehydration condensation method at a reaction temperature of from 180° C. to 260° C. in a nitrogen atmosphere at a composition ratio at which a carboxyl group remains. If necessary, a monohydric or dihydric or higher alcohol other than isosorbide may be used in combination. Further, a monovalent or trivalent or higher carboxylic acid component or an anhydride thereof may be used.

(A)

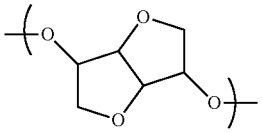

The toner preferably includes a crystalline material.

From the viewpoint of low-temperature fixability, the crystalline material preferably includes an ester-based crystalline material. The amount of the crystalline material is preferably from 1.0 part by mass to 35.0 parts by mass, and more preferably from 2.0 parts by mass to 30.0 parts by mass, based on 100.0 parts by mass of the binder resin.

Having crystallinity means that a clear endothermic peak (melting point) is observed in differential scanning calorimetry DSC.

From the viewpoint of low-temperature fixability, the crystalline material may include a wax (release agent).

A known wax can be used as the wax. Specific examples of the wax include the following.

Hydrocarbon waxes (for example, petroleum waxes and derivatives thereof such as paraffin wax, microcrystalline wax and petrolactam, montan wax and derivatives thereof, hydrocarbon waxes and derivatives thereof obtained by a Fischer-Tropsch method, and polyolefin waxes represented by polyethylene and polypropylene derivatives thereof), carnauba wax, candelilla wax and other natural waxes and derivatives thereof, ester waxes and the like.

Here, derivatives are inclusive of oxides, block copolymers with vinyl monomers, and graft-modified products.

Examples of the ester wax include a monoester compound having one ester bond in one molecule, and polyfunctional ester compounds such as diester compounds having two ester bonds in one molecule, tetrafunctional ester compounds having four ester bonds in one molecule, hexafunctional ester compounds having six ester bonds in one molecule, and the like.

The wax preferably includes at least one compound selected from the group consisting of a monoester compound and a diester compound.

Among them, the monoester compound is more excellent in low-temperature fixability because the ester compound tends to be linear and has high compatibility with the styrene resin.

Specific examples of the monoester compound include waxes mainly including a fatty acid ester such as carnauba wax, montanic acid ester wax, and the like; compounds obtained by partial or complete removal of acid component from such aliphatic esters, such as deoxidized carnauba wax and the like; compounds obtained by subjecting vegetable oils to hydrogenation or the like; methyl ester compounds having a hydroxy group; and saturated fatty acid monoesters such as stearyl stearate, behenyl behenate, and the like.

Specific examples of the diester compound include dibehenyl sebacate, nonanediol dibehenate, behenate terephthalate, stearyl terephthalate, and the like.

The wax may include other known waxes other than the above compounds. In addition, one type of wax may be used alone, or two or more types may be used in combination.

From the viewpoint of low-temperature fixability, the crystalline material may include a crystalline polyester.

The crystalline polyester is preferably obtained by reacting an aliphatic diol and an aliphatic dicarboxylic acid. Among them, a condensation polymer of monomers including an aliphatic diol having from 2 to 12 carbon atoms and/or an aliphatic dicarboxylic acid having from 2 to 12 carbon atoms is preferable.

Examples of the aliphatic diol having from 2 to 12 carbon atoms include the following compounds.

1,2-Ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

Further, an aliphatic diol having a double bond can be used. Examples of the aliphatic diol having a double bond include the following compounds.

2-Butene-1,4-diol, 3-hexene-1,6-diol, and 4-octene-1,8-diol.

Examples of the aliphatic dicarboxylic acid having from 2 to 12 carbon atoms include the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, and 1,12-dodecanedicarboxylic acid. Lower alkyl esters and acid anhydrides of these aliphatic dicarboxylic acids can also be used.

Of these, sebacic acid, adipic acid, and 1,10-decanedicarboxylic acid, and their lower alkyl esters and acid anhydrides are preferred. These may be used alone or as a mixture of two or more.

Further, an aromatic carboxylic acid can also be used. Examples of the aromatic dicarboxylic acid include the following compounds. Terephthalic acid, isophthalic acid, 2,6-naphthalenedicarboxylic acid, and 4,4'-biphenyldicarboxylic acid. Among these, terephthalic acid is preferable in that it is easily available and easily forms a polymer having a low melting point.

A dicarboxylic acid having a double bond can also be used. A dicarboxylic acid having a double bond can be suitably used to prevent hot offset at the time of fixing, since the entire resin can be crosslinked using the double bond.

Examples of such dicarboxylic acids include fumaric acid, maleic acid, 3-hexenedioic acid and 3-octenedioic acid. Other examples include lower alkyl esters and acid anhydrides thereof. Among these, fumaric acid and maleic acid are more preferred.

The method for producing the crystalline polyester is not particularly limited, and the crystalline polyester can be produced by a general polyester polymerization method in which a dicarboxylic acid component and a diol component are reacted. For example, it can be produced by using a direct polycondensation method or a transesterification method depending on the type of the monomer.

The crystalline material preferably includes at least one selected from the group consisting of hydrocarbon waxes, ester waxes and crystalline polyesters, and more preferably includes hydrocarbon waxes and at least one selected from the group consisting of ester waxes and crystalline polyesters.

In the cross-sectional observation of the toner particle by a transmission electron microscope, domains of the crystalline material are present in the region B, and the number-average diameter of the domains is preferably from 20 nm to 300 nm, and more preferably from 20 nm to 100 nm. The number of domains of the crystalline material in the region B is preferably from 10 to 100, and more preferably from 10 to 80.

When the number-average diameter of the domains of the crystalline material is 20 nm or more, the crystalline state can be maintained and the fixing property is effectively exerted. When the number-average diameter is 300 nm or less, the number of interfaces between the crystalline material and the binder resin can be increased, and plasticization can be instantaneously performed during fixing, so that low-temperature fixability can be improved and gloss unevenness can be prevented.

The average diameter of the crystalline material can be controlled by the type of the crystalline material, a manufacturing method in which the crystalline material is instantaneously cooled and crystallized from a state in which the crystalline material is compatible with the binder resin during toner production, and the like.

When the number of domains of the crystalline material is 10 or more, the interface between the crystalline material and the binder resin can be increased, and plasticization can be instantaneously performed at the time of fixing, so that low-temperature fixability can be improved and gloss unevenness can be prevented. When the number of domains is 100 or less, the possibility of plasticizing the binder resin other than at the time of fixing can be reduced, and the storability can be improved.

The number of domains can be controlled by the type and combination of the crystalline materials and a manufacturing method in which the crystalline material is instantaneously cooled and crystallized from a state in which the crystalline material is compatible with the binder resin during toner production.

Next, the relationship between the materials constituting the toner will be described.

It is preferable that the magnetic body includes the hydrophobed magnetic body A, the binder resin includes the resin B, and the toner particle includes the resin C. When a dipole interaction term of Hansen solubility parameter of the hydrophobed magnetic body A is taken as a ($MPa^{1/2}$), a dipole interaction term of Hansen solubility parameter of the resin B is taken as b ($MPa^{1/2}$), and a dipole interaction term of Hansen solubility parameter of the resin C is taken as c ($MPa^{1/2}$), a relationship represented by inequality (1) below is preferably satisfied:

$$b<a<c \quad (1).$$

Here, the "dipole interaction term of Hansen solubility parameter" means a polarization term δp representing energy due to dipole interaction among three parameters constituting the Hansen solubility parameters. The unit of the dipole interaction terms a, b and c of Hansen solubility parameter described in this specification is $MPa^{1/2}$.

Where the dipole interaction term of Hansen solubility parameter is controlled so as to satisfy the relationship of the inequality (1), the binder resin including the resin B, the hydrophobed magnetic body, and the resin C are likely to be arranged at optimal positions in the toner particle. This effect is apparently exerted because the magnitude of the dipole interaction term between the materials is in the order of the inequality (1), polarization between the materials is induced, and the materials are prevented from being arranged integrally. Further, it is considered that the occurrence of fogging can be prevented while improving the trailing end offset even when the toner is used for a long time in a high-temperature and high-humidity environment (temperature: 32.5° C., humidity: 80%).

It is preferable that "a" be from 1.0 to 3.0. It is preferable that "b" be from 1.0 to 3.0, and more preferably from 1.0 to 2.4. Also, "c" is preferably from 4.0 to 8.0.

The value of "a" can be controlled by the surface treatment material of the magnetic body and the treatment method thereof. Further, "b" and "c" can be controlled by the main component of the resin and the molecular structure of the side chain and the like.

In consideration of the relationship between the above three components, a case where toner particles are produced by a suspension polymerization method will be described. Preferably, the toner particles are obtained by granulating a magnetic toner composition including the resin C, the hydrophobed magnetic body A, and a polymerizable monomer capable of forming the resin B in an aqueous medium, and polymerizing the polymerizable monomer. Therefore, there are steps of mixing, dissolving, and granulating these materials. However, due to differences in hydrophobicity and specific gravity, the resin or polymerizable monomer and the magnetic body tend to be non-uniform and it is difficult to control the toner structure even if the dissolution strength is increased.

Therefore, the present inventors considered that a good toner can be obtained in which the vicinity of the surface of the toner particles is controlled to a specific structure by maintaining the affinity balance between the resin B, the hydrophobed magnetic body A, and the resin C, which form the structure of the toner particle. Specifically, the outermost surface of the toner particle is a layer of the resin C, and the second layer has a shell structure formed of a layer including the hydrophobed magnetic body A.

When the above three components satisfy the relationship of the inequality (1), a specific shell structure is easily formed, so that the hardness of the toner particle surface becomes sufficient, and when the toner is used for a long time in a high-temperature and high-humidity environment, embedding of the external additive can be prevented. For this reason, fogging at the time of long-term use in a high-temperature and high-humidity environment can be prevented. As a result, even when the toner is used for a long time in a high-temperature and high-humidity environment, a decrease in developing performance can be further prevented.

The toner may include an external additive.

Examples of the external additive include metal oxide fine particles (inorganic fine particles) such as silica fine particles, alumina fine particles, titania fine particles, zinc oxide fine particles, strontium titanate fine particles, cerium oxide fine particles, and calcium carbonate fine particles. Further, composite oxide fine particles using two or more kinds of metals can be used, and two or more kinds selected from an arbitrary combination among these fine particle groups can also be used.

In addition, resin fine particles or organic-inorganic composite fine particles of resin fine particles and inorganic fine particles can also be used.

The external additive more preferably has at least one kind of particles selected from the group consisting of silica fine particles and organic-inorganic composite fine particles.

Silica fine particles can be exemplified by sol-gel silica fine particles prepared by a sol-gel method, aqueous colloidal silica fine particles, alcoholic silica fine particles, fumed silica fine particles obtained by a gas phase method, and fused silica fine particles.

Examples of the resin fine particles include resin particles of vinyl resin, polyester resin, and silicone resin.

Examples of the organic-inorganic composite fine particles include organic-inorganic composite fine particles composed of resin fine particles and inorganic fine particles.

The amount of the external additive is preferably from 0.1 parts by mass to 20.0 parts by mass based on 100 parts by mass of the toner particles.

The external additive may be subjected to a hydrophobizing treatment with a hydrophobic treatment agent.

Examples of the hydrophobic treatment agent include chlorosilanes such as methyltrichlorosilane, dimethyldichlorosilane, trimethylchlorosilane, phenyltrichlorosilane, diphenyldichlorosilane, t-butyldimethylchlorosilane, vinyltrichlorosilane, and the like; alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxisilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, Γ-aminopropyltriethoxysilane, γ-(2-aminoethyl)aminopropyltrimethoxysilane, γ-(2-aminoethyl)aminopropylmethyldimethoxysilane, and the like; silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, dimethyltetravinyldisilazane, and the like; silicone oils such as dimethyl silicone oil, methyl hydrogen silicone oil, methyl phenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, terminally reactive silicone oil, and the like; siloxanes such as hexamethylcyclotrisiloxane, octamethylcyclotetrasiloxane, decamethylcyclopentasiloxane, hexamethyldisiloxane, octamethyltrisiloxane, and the like; fatty acids and metal salts thereof such as long-chain fatty acids such as undecylic acid, lauric acid, tridecylic acid, dodecylic acid, myristic acid, palmitic acid, pentadecylic acid, stearic acid, heptadecylic acid, arachiic acid, montanic acid, oleic acid, linoleic acid, arachidonic acid, and salts of the above fatty acids with metals such as zinc, iron, magnesium, aluminum, calcium, sodium, lithium, and the like.

Among these, alkoxysilanes, silazanes, and silicone oil are preferably used because hydrophobization can be easily performed. One of these hydrophobic treatment agents may be used alone, or two or more thereof may be used in combination.

The toner may include a plurality of types of external additives in order to improve the flowability and charging performance of the toner.

An example of a method for producing the toner will be described below, but this example is not limiting.

In the present invention, the production method for keeping the area percentages A1, A2 and A3, and A2/A1 within the aforementioned ranges is not particularly limited, but it is preferable to produce the toner particles in an aqueous medium by a dispersion polymerization method, an association aggregation method, a dissolution suspension method, a suspension polymerization method, an emulsion polymerization method and the like. The suspension polymerization method is more preferable because magnetic bodies can be easily arranged to be present in the vicinity of the surface of the toner particle, so that a toner satisfying suitable physical properties can be easily obtained. That is, the toner particles are preferably suspension polymerization toner particles.

In the suspension polymerization method, for example, a polymerizable monomer capable of forming a binder resin (resin B), the magnetic bodies and, if necessary, a resin C, a crystalline material, a colorant, a polymerization initiator, a crosslinking agent, a charge control agent and other additives are uniformly dispersed to obtain a polymerizable monomer composition. Then, the obtained polymerizable monomer composition is dispersed and granulated in a continuous layer (for example, an aqueous phase) including a dispersion stabilizer by using a suitable stirrer, and then a polymerization reaction is performed using a polymerization initiator to obtain toner particles having a desired particle size.

As the polymerizable monomer, those described above as the monomer for the vinyl resin can be used. The preferred examples are listed hereinbelow.

Styrene monomers such as styrene, o-methylstyrene, m-methylstyrene, p-methylstyrene, p-methoxystyrene, p-ethylstyrene and the like.

Acrylic acid esters such as alkyl acrylates (methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, and the like), 2-chloroethyl acrylate, phenyl acrylate, and the like.

Methacrylic acid esters such as alkyl methacrylates (methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, and the like), phenyl methacrylate, dimethylaminoethyl methacrylate, diethylaminoethyl methacrylate, and the like.

Other monomers such as acrylonitrile, methacrylonitrile, and acrylamide. These monomers can be used alone or as a mixture.

Of the above-mentioned monomers, the use of a styrene-based monomer alone or in combination with other monomers such as acrylic acid esters and methacrylic acid esters is preferable because the toner structure is easily controlled and developing characteristics and durability of the toner can be easily improved. In particular, it is preferable that the binder resin includes 50% by mass or more of a styrene acrylic resin.

As the polymerization initiator to be used in the production of the toner particles by the polymerization method, those having a half-life at the time of the polymerization reaction of from 0.5 h to 30 h are preferable. In addition, it is preferable that the polymerization initiator be used in an amount of from 0.5 parts by mass to 20 parts by mass based on 100 parts by mass of the polymerizable monomer. In such a case, a polymer having a maximum molecular weight of from 5000 to 50000 can be obtained, and the toner can have preferable strength and appropriate melting characteristics.

Specific examples of polymerization initiators include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate, and the like.

Among them, t-butyl peroxypivalate is preferred.

When the toner is produced by a polymerization method, a crosslinking agent may be added.

From the viewpoint of easily obtaining a stress propagation effect, it is preferable that the crosslinking agent be a crosslinking agent that does not include a highly rigid structure, such as an aromatic hydrocarbon group such as a phenylene group or the like.

The amount of the crosslinking agent to be added is preferably from 0.05 parts by mass to 15.00 parts by mass, and more preferably from 0.10 parts by mass to 3.00 parts by mass with respect to 100 parts by mass of the polymerizable monomer. More preferably, the amount is from 0.20 parts by mass to 2.50 parts by mass.

The aqueous medium in which the polymerizable monomer composition is to be dispersed may include a dispersion stabilizer. As the dispersion stabilizer, known surfactants, organic dispersants and inorganic dispersants can be used. Among them, inorganic dispersants are preferred because they have dispersion stability owing to their steric hindrance, so that even if the reaction temperature is changed, the stability is hardly lost, the washing is easy, and the toner is hardly adversely affected thereby.

Examples of such inorganic dispersants include polyvalent metal phosphates such as tricalcium phosphate, magnesium phosphate, aluminum phosphate, zinc phosphate, hydroxyapatite, and the like; carbonates such as calcium carbonate, magnesium carbonate, and the like; inorganic salts such as calcium metasilicate, calcium sulfate, barium sulfate, and the like; and inorganic compounds such as calcium hydroxide, magnesium hydroxide, aluminum hydroxide, and the like.

The amount of the inorganic dispersant added is preferably from 0.2 parts by mass to 20 parts by mass based on 100 parts by mass of the polymerizable monomer. The dispersion stabilizers may be used alone or in combination of two or more. Further, from 0.001 parts by mass to 0.1 parts by mass of a surfactant may be used in combination.

When an inorganic dispersant is used, it may be used as it is, but in order to generate finer particles, fine particles of the inorganic dispersant can be generated and used in an aqueous medium.

For example, in the case of tricalcium phosphate, an aqueous solution of sodium phosphate and an aqueous solution of calcium chloride can be mixed under high-speed stirring to generate fine particles of water-insoluble calcium phosphate, which enables more uniform and fine dispersion.

Examples of the surfactant include sodium dodecylbenzenesulfate, sodium tetradecylsulfate, sodium pentadecylsulfate, sodium octylsulfate, sodium oleate, sodium laurate, sodium stearate, potassium stearate, and the like.

In the step of polymerizing the polymerizable monomer, the polymerization temperature is usually set to 40° C. or higher, preferably from 50° C. to 90° C. When the polymerization is carried out in this temperature range, for example, a release agent or the like to be sealed inside is precipitated by phase separation, and the encapsulation becomes more complete.

After polymerizing the polymerizable monomer, it is preferable to perform the following cooling step. The dispersion in which the toner particles are dispersed in the aqueous medium is heated to a temperature exceeding the melting point of the crystalline material. However, if the polymerization temperature exceeds the melting point, this operation is not necessary.

After raising the temperature, the dispersion is cooled to around room temperature at a cooling rate of from 3° C./min to 200° C./min (preferably from 3° C./min to 150° C./min) in order to increase the crystallinity of the crystalline material.

After the cooling step, the dispersion may be heated to about 50° C. and subjected to a heat treatment.

The heat treatment is preferably performed for about 1 h to 24 h, more preferably for about 2 h to 10 h.

The obtained polymer particles are filtered, washed and dried by a known method to obtain toner particles. The toner particles may be used as such as toner. The toner may be obtained by mixing an external additive with the toner particles and attaching the external additive to the surface of the toner particles. It is also possible to incorporate a classifying step into the production process to cut coarse powder and fine powder included in the toner particles.

Methods for measuring various physical properties of the toner of the present invention will be described below.

Method for Measuring Number-Average Particle Diameter (D1) of Toner

The number-average particle diameter (D1) of the toner is calculated as follows.

A precision particle diameter distribution measuring apparatus "Coulter Counter Multisizer 3®" (manufactured by Beckman Coulter, Inc.) based on a pore electric resistance method and equipped with a 100-μm aperture tube is used as a measurement device. The dedicated software "Beckman Coulter Multisizer 3 Version 3.51" (manufactured by Beckman Coulter, Inc.) is used for setting measurement conditions and analyzing the measurement data. The measurement is performed with 25,000 effective measurement channels.

A solution prepared by dissolving special grade sodium chloride in ion exchanged water to a concentration of about 1% by mass, for example, "ISOTON II" (manufactured by Beckman Coulter, Inc.), can be used as the electrolytic aqueous solution to be used for the measurement.

The dedicated software is set up in the following manner before the measurement and analysis.

The total count number in a control mode is set to 50000 particles on a "Changing Standard Operating Method (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "Threshold/Measure Noise Level". Further, the current is set to 1600 μA, the gain is set to 2, the electrolytic solution is set to ISOTON II, and "Flush Aperture Tube" of "After Each Run" is checked.

In the "Convert Pulses to Size Settings" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "Flush Aperture Tube" function of the dedicated software.

(2) Approximately 30 ml of the electrolytic aqueous solution is placed in a glass 100 mL flat-bottom beaker. Then, about 0.3 mL of a diluted solution obtained by about 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersant thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of about 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion process, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the number-average particle diameter (D1) is calculated. The "Average Diameter" on the "Analyze/Number Statistics (Arithmetic Mean)" screen obtained when the graph/(% by number) is set in the dedicated software is taken as the number-average particle diameter (D1).

Number-Average Diameter of Primary Particles of Magnetic Body

After sufficiently dispersing the magnetic bodies to be observed in an epoxy resin, curing is performed in an atmosphere at a temperature of 40° C. for 2 days to obtain a cured product. The obtained cured product is sliced with a microtome to obtain a flaky sample, and the particle diameter of 100 magnetic iron oxide particles in the visual field is measured with a transmission electron microscope (TEM) at a magnification of 40,000 times. Then, the number-average diameter is calculated based on the equivalent diameter of a circle equal to the projected area of the magnetic body. This method can be used not only for measurement of magnetic bodies as a raw material but also for measurement of magnetic bodies present inside the toner by using the toner as a sample.

Method for Observing Cross Section of Ruthenium-Stained Toner by Transmission Electron Microscope (TEM)

Cross-sectional observation of the toner with a transmission electron microscope (TEM) can be performed as follows. The cross section of the toner is observed by staining with ruthenium. For example, a crystalline resin or the like included in the toner is stained with ruthenium more than an amorphous resin such as a binder resin, so that the contrast becomes clear and observation is facilitated. Since the amount of ruthenium atoms differs depending on the intensity of the staining, the strongly stained portion includes many of these atoms, does not transmit the electron beam, and becomes black on the observed image, and the weakly stained portion easily transmits the electron beam and becomes white on the observed image.

First, a toner is sprayed on a cover glass (Matsunami Glass Co., Ltd., angular cover glass, Square Shape No. 1) so as to form a monolayer, and an Os film (5 nm) and a naphthalene film (20 nm) are coated as protective films by using an Osmium Plasma Coater (filgen, Inc., OPC80T).

Next, a PTFE tube (ϕ1.5 mm (inner diameter)×ϕ3 mm (outer diameter)×3 mm) is filled with a photocurable resin D800 (JEOL, Ltd.), and the cover glass is placed quietly on the tube in the orientation such that the toner contacts the photocurable resin D800. After curing the resin by irradiation with light in this state, the cover glass and the tube are removed to form a columnar resin in which the toner is embedded on the outermost surface.

The columnar resin is cut at a distance equal to the radius of the toner (4.0 μm when the weight-average particle diameter (D4) is 8.0 μm) from the outermost surface at a cutting speed of 0.6 mm/s by using an ULTRASONIC ULTRAMICROTOME (Leica Microsystems Inc., UC7) to open the cross section of the toner. Next, cutting is performed to obtain a film thickness of 250 nm and prepare a slice sample having the toner cross section. By cutting in such a manner, a cross section of the toner central portion is obtained.

The obtained slice sample is stained in a $RuO_4$ gas at a 500 Pa atmosphere for 15 min using a vacuum electron dyeing apparatus (filgen, Inc., VSC4R1H,), and TEM observation is performed using a TEM (JEOL, Ltd., JEM2800).

An image with a TEM probe size of 1 nm and an image size of 1,024 pixels×1,024 pixels is acquired. Also, the Contrast of the Detector Control panel of the bright image field is adjusted to 1425, the Brightness to 3750, the Contrast of the Image Control panel to 0.0, the Brightness to 0.5, and the Gamma to 1.00.

Identification of Domain of Crystalline Materials

Based on the TEM image of the cross section of the toner, the domain of the crystalline material is identified by the following procedure. Where crystalline materials (crystalline polyester and release agent) are available as raw materials, the crystal structure thereof is observed in the same manner as in the above-mentioned observation method of the toner cross section by transmission electron microscope (TEM) with ruthenium staining, and an image of the lamella structure of each crystal of the raw materials is obtained. These are compared with the lamella structures of the domains in the cross section of the toner, and where the layer interval of the lamella is 10% or less, it is possible to specify the raw material forming the domains in the cross section of the toner.

Isolation of Crystalline Material

Where raw materials for crystalline materials (crystalline polyester and release agent) are not available, an isolation operation is performed as follows. First, the toner is dispersed in ethanol, which is a poor solvent for the toner, and the temperature is raised to that exceeding the melting points of the crystalline polyester and the release agent. At this time, pressure may be applied as necessary. At this point, the crystalline polyester and the release agent for which the melting point has been exceeded are melted. Thereafter, by performing solid-liquid separation, a mixture of the crystalline polyester and the release agent can be collected from the toner. By classifying this mixture for each molecular weight, a crystalline material can be isolated.

Measurement of Number-Average Diameter of Domains of Crystalline Material

The number-average diameter of the domains of the crystalline material is determined from the major axis of the domains of the crystalline material based on the TEM image.

The major axis of the domain of the crystalline material is measured based on a TEM image obtained by observing the cross section of the toner with a transmission electron microscope (TEM) with ruthenium staining. At this time, a cross section of 100 or more toner particles is observed. All domains are measured and the number-average diameter is calculated.

Measurement of Number of Domains of Crystalline Material

The number of domains of the crystalline material included in the toner cross section is measured in the same manner as in the measurement of the number-average diameter of the domains of the crystalline material. This is performed for 100 or more toner cross sections, and the number of domains per one toner cross section is taken as the number of domains of the crystalline material.

Measurement of Area Percentages A1, A2 and A3

A method for measuring the degree of surface distribution unevenness of the magnetic bodies in the cross section of the toner particle observed with a transmission electron microscope (TEM) is as follows.

Next, the obtained TEM image is binarized using image processing software "ImagerJ" (available from https://imagej.Nih.gov/ij/). Thereafter, a circle equivalent diameter (projected area circle equivalent diameter) is obtained from the binarized image of the cross section, and a cross section for which the value of the circle equivalent diameter is included in a range of ±5% of the number-average particle diameter (D1) (μm) of the toner is selected.

From the TEM image of the corresponding particles, regions other than those necessary for the measurement are masked using "ImageJ", and the area of the unmasked region inside the toner outline and the total area of the magnetic bodies present in the unmasked region are calculated. A method for obtaining the area ratio A1 using this method will be specifically described hereinbelow.

First, binarization is performed so that the contour and the inside of the obtained TEM image (hereinafter, referred to as image 1) of the contour of the cross section of the toner particle are white, and the other background portions are black (hereinafter, referred to as image 2).

Next, in order to calculate the magnification of the mask, the length per unit pixel in the image 1 is calculated. Next, from the calculated value, the number of pixels fit in 200 nm, which is the distance from the contour of the toner particle to the boundary line of the region A, is calculated (hereinafter referred to as x1). Similarly, the number of pixels fit in the toner particle diameter measured by using the above-described method is likewise calculated (hereinafter referred to as x2). Then, the magnification M of the mask is calculated from $(x2-x1)/x2$.

Next, the image 2 is reduced to the calculated magnification M (the reduced image is referred to as image 3). At this time, the settings are such that the toner particle contour and the inside are black, unlike the image 2, and other background portions are white (become transparent).

Figure 3:
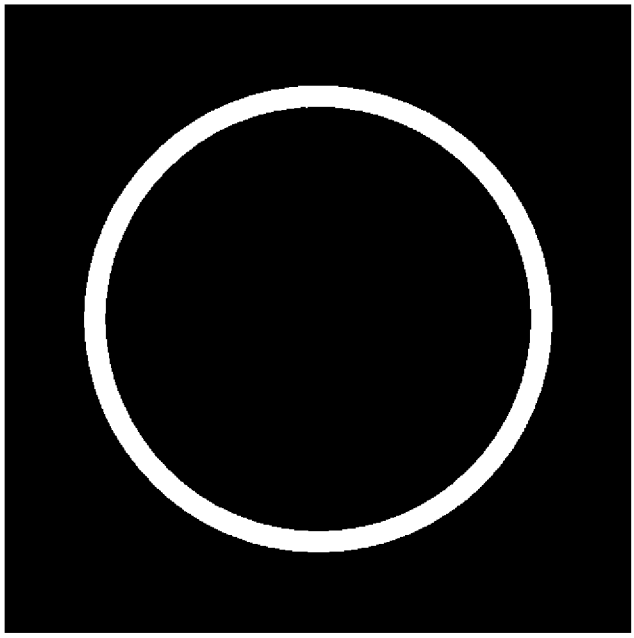
FIG. 3 is an image diagram of a mask to be used for image processing.

Next, the image 2 and the image 3 are added. At this time, the image 2 and the image 3 are added using "Image Calculator" which is a function of "ImageJ", and an image 4 is created, such as shown in FIG. 3, in which the region from the contour of the toner particle to 200 nm toward the centroid of the toner particle is white, and the other parts are black. The area S1 of the white region in the image 4 is measured.

Next, the created image 4 and the aforementioned TEM image are similarly added using "Image Calculator" to create an image 5 in which the region outside the measurement segment is masked. The image 5 is binarized, and a magnetic body area S2 in the mask is measured.

Finally the area percentage A1 occupied by the magnetic bodies in the region A is calculated by $S2/S1\times100$.

Regarding the area percentages A2 and A3, the calculation is performed by the same procedure except that the range of the region is changed to from 200 nm to 400 nm to the centroid for A2, and from 400 nm to the centroid for A3. The cross section of 100 toner particles is observed, and the arithmetic mean value is adopted.

Method for Measuring Dipole Interaction Term of Hansen Solubility Parameter

The dipole interaction term of Hansen solubility parameter of the hydrophobed magnetic body A, resin B and resin C is calculated as follows.

When raw materials are available, first, the molecular structure of the raw material of the hydrophobic treatment agent, and molecular structures of respective raw materials for the resin B and the resin C are specified from the SDS or the like. Based on the structural formulas, calculation is performed from calculation software HSPiP (available from http://pirika.com/JP/HSP/index.html).

Further, when raw materials cannot be obtained directly or when measurements are performed on the available toner, the calculation can be performed by identifying the constituent materials by using an analytical instrument such as a nuclear magnetic resonance apparatus (NMR) and gas chromatography/mass spectrometry (GC/MS).

EXAMPLES

Hereinafter, the present invention will be described based on Examples, but the present invention is not limited thereto. In the following formulations, parts are by weight unless otherwise specified.

Production Example of Resin C1

A total of 100 parts of a mixture obtained by mixing raw material monomers, other than trimellitic anhydride, in the loaded amounts shown in Table 1 below, and 0.52 parts of di(2-ethylhexanoic acid) tin as a catalyst were placed in a polymerization tank equipped with a nitrogen introduction line, a dehydration line and a stirrer. Next, after the inside of the polymerization tank was set to a nitrogen atmosphere, a polycondensation reaction was performed over 6 h while heating at 200° C.

After the temperature was further raised to 210° C., trimellitic anhydride was added, the pressure in the polymerization tank was reduced to 40 kPa, and then the condensation reaction was further performed. Table 1 shows the dipole interaction term c of Hansen solubility parameter of the obtained resin C1.

Production Examples of Resins C2 and C3

The resins C2 and C3 were produced by performing the same operations as for the resin C1 at the loaded amounts of the raw material monomers shown in Table 1 below. Table 1 shows the dipole interaction term c of Hansen solubility parameter of the obtained resin.

TABLE 1

| Type of resin C | Alcohol component (mol) BPA (2 moles PO) | EG | Isosorbide | Acid component (mol) TPA | TMA | Hansen dipole interaction term c |
|---|---|---|---|---|---|---|
| C1 | 60 | 36 | 5 | 86 | 4 | 6.0 |
| C2 | 80 | 36 | 0 | 75 | 1 | 5.5 |
| C3 | 40 | 30 | 0 | 65 | 7 | 6.4 |

Abbreviations in the table are as follows.

BPA (2 moles PO): bisphenol A propylene oxide 2 moles adduct

EG: ethylene glycol

TPA: terephthalic acid

TMA: trimellitic anhydride

Also, the unit of the Hansen dipole interaction term is ($MPa^{1/2}$), including the tables below.

Production Example of Crystalline Material D1

| | |
|---|---|
| Sebacic acid | 100.0 parts |
| 1,9-Nonanediol | 100.0 parts |
| Dibutyltin oxide | 0.1 part |

The above materials were placed in a heated and dried two-necked flask, nitrogen gas was introduced into the vessel to maintain an inert atmosphere, and the temperature was raised while stirring. Thereafter, stirring was performed at 180° C. for 6 h. Thereafter, the temperature was gradually raised to 230° C. under reduced pressure while stirring was continued, and further maintained for 2 h. When the mixture became viscous, the mixture was air-cooled to stop the reaction, thereby obtaining a crystalline material D1.

Crystalline Materials D2 to D4

Data relating to the crystalline materials D2 to D4 are shown in Table 2.

TABLE 2

| Crystalline material No. | Name of material |
|---|---|
| D1 | Crystalline polyester |
| D2 | Dibehenyl sebacate |
| D3 | Behenyl behenate |
| D4 | Behenyl stearate |

Crystalline Material E1

Hydrocarbon wax (HNP-51: manufactured by Nippon Seiro Co., Ltd.) was used as the crystalline material E1.

Production Example of Magnetic Iron Oxide 1

A total of 55 liters of a 4.0 mol/L aqueous sodium hydroxide solution was mixed and stirred with 50 liters of an aqueous solution of ferrous sulfate including 2.0 mol/L of $Fe^{2+}$ to obtain an aqueous solution of ferrous salt including a ferrous hydroxide colloid. This aqueous solution was maintained at 85° C., and an oxidation reaction was performed while blowing air at 20 L/min to obtain a slurry including core particles.

After the obtained slurry was filtered with a filter press and washed, the core particles were dispersed again in water and reslurried. To this reslurry liquid, sodium silicate was added in an amount of 0.20% by mass in terms of silicon per 100 parts of core particles, the pH of the slurry liquid was adjusted to 6.0, and stirring was performed to obtain magnetic iron oxide particles having a silicon-rich surface. The obtained slurry was filtered with a filter press and washed, and further reslurried with ion exchanged water.

A total of 500 g (10% by mass based on magnetic iron oxide) of ion exchange resin SK110 (manufactured by Mitsubishi Chemical Corporation) was added to this reslurry liquid (solid amount 50 g/L), and the mixture was stirred for 2 h to perform ion exchange. Thereafter, the ion-exchange resin was removed by filtration through a mesh, followed by filtration with a filter press, washing, drying and pulverizing to obtain magnetic iron oxide 1 having a number-average diameter of 200 nm.

Production Example of Magnetic Iron Oxide 2

Magnetic iron oxide 2 as spherical magnetite particles having a number-average particle diameter of primary particles of 160 nm was obtained by changing the production conditions of magnetic iron oxide 1 in the Production Example of Magnetic Iron Oxide 1.

Production Example of Magnetic Iron Oxide 3

Magnetic iron oxide 3 as spherical magnetite particles having a number-average particle diameter of primary particles of 300 nm was obtained by changing the production conditions of magnetic iron oxide 1 in the Production Example of Magnetic Iron Oxide 1.

Production Example of Magnetic Iron Oxide 4

Magnetic iron oxide 4 as spherical magnetite particles having a number-average particle diameter of primary particles of 350 nm was obtained by changing the production conditions of magnetic iron oxide 1 in the Production Example of Magnetic Iron Oxide 1.

Production Example of Magnetic Iron Oxide 5

Magnetic iron oxide 5 as spherical magnetite particles having a number-average particle diameter of primary particles of 260 nm was obtained by changing the production conditions of magnetic iron oxide 1 in the Production Example of Magnetic Iron Oxide 1.

Production of Silane Compound 1

A total of 30 parts of n-decyltrimethoxysilane was added dropwise to 70 parts of ion exchanged water while stirring. Thereafter, the aqueous solution was maintained at a pH of 5.5 and a temperature of 55° C., and was dispersed using a disper blade for 120 min at a peripheral speed of 0.46 m/s to perform hydrolysis. Thereafter, the pH of the aqueous solution was adjusted to 7.0, and the solution was cooled to 10° C. to stop the hydrolysis reaction. Thus, an aqueous solution including a silane compound 1 was obtained.

Production of Silane Compounds 2 to 5

Using the alkoxysilanes shown in Table 3, aqueous solutions including silane compounds 2 to 5 were obtained in the same manner as in the method for producing the silane compound 1.

TABLE 3

| Silane compound No. | Raw material of silane compound |
|---|---|
| 1 | n-Butyltrimethoxysilane |
| 2 | n-Octyltrimethoxysilane |
| 3 | n-Decyltrimethoxysilane |
| 4 | n-Tetradecyltrimethoxysilane |
| 5 | n-Hexadecyltrimethoxysilane |

Production of Hydrophobed Magnetic Body A1

A total of 10.0 kg of the magnetic iron oxide 1 was loaded in Simpson Mix-Muller (model MSG-0L, manufactured by SINTOKOGIO, LTD.) and pulverized for 30 min.

Thereafter, 95 g of an aqueous solution including the silane compound 1 was added as a silane coupling agent into the apparatus, and the apparatus was operated for 1 h to hydrophobize the particle surface of the magnetic iron oxide 1 with the silane coupling agent, thereby obtaining a hydrophobed magnetic body A1. The physical properties are shown in Table 4.

Production of Hydrophobed Magnetic Bodies A2 to A7

In the method for producing the hydrophobed magnetic body A1, the type of the silane compound was changed, as appropriate, as described in Table 4, and the spray amount of the silane compound was changed, as appropriate. As a result, desired hydrophobed magnetic bodies A2 to A7 adjusted to the desired "Amount of carbon derived from silane compound" were obtained. The physical properties are shown in Table 4 below.

Regarding the treatment method, FM indicates a dry treatment method using a Mitsui Henschel Mixer (Mitsui Miike Kakoki Co., Ltd.), and wet treatment indicates treatment in a liquid.

TABLE 4

| Treated magnetic body A No. | Magnetic iron oxide No. | Particle diameter [nm] | Treatment agent | Addition amount of treatment agent (% by mass) | Treatment method | Amount of carbon derived from silane compound | Hansen dipole interaction term a |
|---|---|---|---|---|---|---|---|
| A1 | 1 | 200 | Silane compound 1 | 0.94 | MIX-Muller | 0.4 | 1.8 |
| A2 | 1 | 200 | Silane compound 2 | 1.50 | MIX-Muller | 0.4 | 2 |
| A3 | 1 | 200 | Silane compound 3 | 0.30 | MIX-Muller | 0.4 | 1.4 |
| A4 | 1 | 200 | Silane compound 4 | 0.30 | MIX-Muller | 0.4 | 1.2 |
| A5 | 2 | 160 | Silane compound 1 | 1.30 | MIX-Muller | 0.4 | 1.8 |
| A6 | 3 | 300 | Silane compound 1 | 0.70 | MIX-Muller | 0.4 | 1.8 |
| A7 | 4 | 350 | Silane compound 1 | 0.60 | MIX-Muller | 0.4 | 1.8 |
| A8 | 1 | 200 | Silane compound 1 | 1.12 | FM | 0.4 | 2.4 |
| A9 | 5 | 260 | Silane compound 5 | 1.00 | Wet | 0.4 | 2.4 |

The unit of the amount of carbon derived from the silane compound is "% by mass".

Production of Hydrophobed Magnetic Body A8

After the magnetic iron oxide 1 was put into a Henschel mixer (Mitsui Miike Kakoki Co., Ltd.), the silane compound 1 (in an amount to constitute 1.12% by mass of the magnetic iron oxide 1) was added while spraying in a state where the magnetic iron oxide 1 was dispersed at a rotation speed of 34.5 m/s.

Next, after dispersing in the same state for 10 min, the magnetic bodies on which the silane compound 1 was adsorbed were taken out and dried while being allowed to stay gently at 160° C. for 2 h, and the condensation reaction of the silane compound 1 was advanced. Thereafter, a magnetic body that passed through a sieve having openings of 100 μm was obtained as a hydrophobed magnetic body A8. The physical properties are shown in Table 4.

Production of Hydrophobed Magnetic Body A9

A total of 1.50 parts of the silane compound 1 was added as a silane coupling agent to magnetic iron oxide 5 (100 parts), followed by sufficient stirring. The produced magnetic iron oxide particles were washed, filtered and dried by a conventional method. Thereafter, a magnetic body that passed through a sieve having openings of 100 μm was obtained as a hydrophobed magnetic body A9. The physical properties are shown in Table 4.

Production of Toner Particles 1

A total of 450 parts of a 0.1 mol/L-$Na_3PO_4$ aqueous solution was added to 720 parts of ion exchanged water followed by heating to a temperature of 60° C., and then 67.7 parts of a 1.0 mol/L-$CaCl_2$ aqueous solution was added to obtain an aqueous medium including a dispersion stabilizer.

| | |
|---|---|
| Styrene | 72.0 parts |
| n-Butyl acrylate | 28.0 parts |
| 1,6-Hexanediol diacrylate | 1.5 parts |
| Resin C1 | 5.0 parts |
| Negative charge control agent T-77 (manufactured by Hodogaya Chemical Co., Ltd.) | 1.0 part |
| Hydrophobed magnetic body A1 | 65.0 parts |

The above materials were uniformly dispersed and mixed using an attritor (Nippon Coke Industry Co., Ltd.). This monomer composition was heated to a temperature of 60° C., and the following materials were mixed and dissolved therein to obtain a polymerizable monomer composition.

| | |
|---|---|
| Crystalline material D1 | 10.0 parts |
| Crystalline material E1 | 5.0 parts |
| Polymerization initiator (t-butyl peroxypivalate (25 mass % toluene solution)) | 10.0 parts |

The polymerizable monomer composition was loaded into the aqueous medium and granulated by stirring at a rotation speed of 10000 rpm for 15 min with T. K. HOMOMIXER (Tokushu Kika Kogyo Co., Ltd.) in a $N_2$ atmosphere at a temperature of 60° C. Thereafter, the mixture was stirred with a paddle stirring blade, and a polymerization reaction was performed at a reaction temperature of 70° C. for 300 min.

After completion of the reaction, the temperature was raised to 98° C. and distillation was performed for 3 h to obtain a reaction slurry. Thereafter, as a cooling step, water at 0° C. was poured into the suspension, and the suspension was cooled from 100° C. to 30° C. at a rate of 100° C./min, then heated to 50° C. and allowed to stand for 6 h.

The suspension was then naturally cooled to 25° C. at room temperature. The cooling rate at that time was 1° C./min. Thereafter, hydrochloric acid was added to the suspension for sufficient washing thereby dissolving the dispersion stabilizer, followed by filtration and drying to obtain toner particles 1. The formulation is shown in Table 5.

TABLE 5

| Toner particle | Treated magnetic body A | | Resin B | | | | Resin C | | Crystalline material D | | Release agent E1 | Cooling rate to 30° C. |
|---|---|---|---|---|---|---|---|---|---|---|---|---|
| | | | Styrene | n-Butyl acrylate | Acrylonitrile | Hansen dipole interaction | | | | | | |
| No. | No. | Parts | (parts) | (parts) | (parts) | term b | No. | Parts | No. | Parts | Parts | (° C./min) |
| 1 | A1 | 65 | 72 | 28 | 0.0 | 1.3 | C1 | 5.0 | D1 | 10 | 5 | 100° C./min |
| 2 | A1 | 80 | 72 | 28 | 0.0 | 1.3 | C1 | 5.0 | D1 | 10 | 5 | 100° C./min |
| 3 | A1 | 60 | 72 | 28 | 0.0 | 1.3 | C1 | 5.0 | D1 | 10 | 5 | 100° C./min |
| 4 | A1 | 50 | 72 | 28 | 0.0 | 1.3 | C1 | 5.0 | D1 | 10 | 5 | 100° C./min |
| 5 | A2 | 65 | 72 | 28 | 0.0 | 1.3 | C1 | 5.0 | D1 | 10 | 5 | 100° C./min |
| 6 | A3 | 65 | 72 | 28 | 0.0 | 1.3 | C1 | 5.0 | D1 | 10 | 5 | 100° C./min |
| 7 | A4 | 65 | 79 | 21 | 0.0 | 1.1 | C1 | 5.0 | D1 | 10 | 5 | 100° C./min |
| 8 | A1 | 60 | 72 | 28 | 0.2 | 1.5 | C1 | 5.0 | D1 | 10 | 5 | 100° C./min |
| 9 | A2 | 60 | 79 | 21 | 0.0 | 1.1 | C1 | 5.0 | D1 | 10 | 5 | 100° C./min |
| 10 | A3 | 65 | 79 | 21 | 0.0 | 1.1 | C2 | 5.0 | D1 | 10 | 5 | 100° C./min |
| 11 | A4 | 65 | 72 | 28 | 0.0 | 1.3 | C3 | 5.0 | D1 | 10 | 5 | 100° C./min |
| 12 | A1 | 50 | 72 | 28 | 0.0 | 1.3 | C1 | 5.0 | D1 | 10 | 5 | 100° C./min |
| 13 | A1 | 130 | 72 | 28 | 0.0 | 1.3 | C1 | 5.0 | D1 | 10 | 5 | 100° C./min |
| 14 | A5 | 40 | 72 | 28 | 0.0 | 1.3 | C1 | 5.0 | D1 | 10 | 5 | 100° C./min |
| 15 | A6 | 105 | 72 | 28 | 0.0 | 1.3 | C1 | 5.0 | D1 | 10 | 5 | 100° C./min |
| 16 | A1 | 65 | 72 | 28 | 0.0 | 1.3 | C1 | 5.0 | D1 | 10 | 5 | 10° C./min |
| 17 | A1 | 65 | 72 | 28 | 0.0 | 1.3 | C1 | 5.0 | D2 | 5 | 5 | 100° C./min |
| 18 | A1 | 65 | 72 | 28 | 0.0 | 1.3 | C1 | 5.0 | D3 | 5 | 5 | 100° C./min |
| 19 | A1 | 65 | 72 | 28 | 0.0 | 1.3 | C1 | 5.0 | D4 | 10 | 5 | 100° C./min |
| 20 | A2 | 70 | 79 | 21 | 0.0 | 1.1 | C2 | 5.0 | D1 | 10 | 5 | 100° C./min |
| 21 | A1 | 175 | 72 | 28 | 0.0 | 1.3 | C1 | 5.0 | D1 | 10 | 5 | 100° C./min |
| 22 | A1 | 47 | 72 | 28 | 0.0 | 1.3 | C1 | 5.0 | D1 | 10 | 5 | 100° C./min |
| 23 | A7 | 80 | 72 | 28 | 0.0 | 1.3 | C1 | 5.0 | D1 | 10 | 5 | 100° C./min |
| 24 | A2 | 65 | 72 | 28 | 1.1 | 2.2 | C1 | 5.0 | D1 | 10 | 5 | 100° C./min |
| 25 | A1 | 65 | 72 | 28 | 0.0 | 1.3 | C1 | 5.0 | D1 | 10 | 5 | 0° C./min |
| 26 | A1 | 65 | 72 | 28 | 0.0 | 1.3 | C1 | 5.0 | — | — | 5 | 0° C./min |
| 27 | A1 | 45 | 72 | 28 | 0.0 | 1.3 | C1 | 5.0 | D1 | 10 | 5 | 100° C./min |
| 28 | A8 | 65 | 72 | 28 | 0.0 | 1.3 | C1 | 5.0 | D1 | 10 | 5 | 100° C./min |
| 29 | A1 | 65 | 72 | 28 | 0.5 | 1.7 | C1 | 5.0 | D1 | 10 | 5 | 100° C./min |
| 30 | A9 | 70 | 75 | 25 | 0.0 | 1.2 | C1 | 5.0 | D1 | 10 | 15 | 50° C./min |
| 31 | A8 | 90 | 79 | 21 | 0.0 | 1.1 | C1 | 5.0 | D4 | 10 | 5 | 3° C./min |

Production of Toner Particles 2 to 31

Toner particles 2 to 31 were obtained by performing the same operations as in the Production of Toner Particles 1, except that the types and amounts of the magnetic body A, monomers constituting the resin B, the resin C, the crystalline material D and the crystalline material E, and the cooling rate in the cooling step were changed as shown in Table 5.

Production Example of Toner 1

A total of 0.3 parts of sol-gel silica fine particles having a number-average particle diameter of primary particles of 115 nm was added to 100 parts of toner particles 1, and mixing was performed using a FM mixer (manufactured by Nippon Coke Industries, Ltd.).

Thereafter, 0.9 parts of hydrophobic silica fine particles obtained by treating fumed silica fine particles having a number-average particle diameter of primary particles of 12 nm with hexamethyldisilazane and then treated with silicone oil and having a BET specific surface area value of 120 $m^2/g$ after the treatment was further added, followed by likewise mixing with the FM mixer (manufactured by Nippon Coke Industries, Ltd.) to obtain a toner 1. The physical properties are shown in Table 6.

Production Examples of Toners 2 to 31

Toners 2 to 31 were obtained in the same manner as in the Production Example of Toner 1 except that the toner particles shown in Table 6 were used. The physical properties of the obtained toners are shown in Table 6.

TABLE 6

| Toner No. | Toner particle No. | Area percentage A1 | Area percentage A2 | A2/A1 | A3 | Crystalline material in region B: Number-average particle diameter of domains (nm) | Crystalline material in region B: Number of domains | D1 μm |
|---|---|---|---|---|---|---|---|---|
| 1 | 1 | 53% | 24% | 0.45 | 5% | 50 | 30 | 7.5 |
| 2 | 2 | 85% | 23% | 0.27 | 3% | 47 | 31 | 7.5 |
| 3 | 3 | 45% | 25% | 0.56 | 5% | 49 | 31 | 7.5 |
| 4 | 4 | 38% | 25% | 0.66 | 5% | 53 | 29 | 7.5 |
| 5 | 5 | 53% | 37% | 0.70 | 9% | 55 | 28 | 7.5 |
| 6 | 6 | 53% | 29% | 0.55 | 7% | 57 | 27 | 7.5 |
| 7 | 7 | 53% | 0% | 0.00 | 0% | 48 | 32 | 7.5 |
| 8 | 8 | 47% | 28% | 0.60 | 5% | 51 | 31 | 7.5 |
| 9 | 9 | 40% | 30% | 0.75 | 9% | 53 | 30 | 7.5 |
| 10 | 10 | 43% | 32% | 0.74 | 10% | 55 | 29 | 7.5 |
| 11 | 11 | 40% | 5% | 0.13 | 0% | 52 | 30 | 7.5 |
| 12 | 12 | 54% | 23% | 0.43 | 5% | 60 | 27 | 4.0 |
| 13 | 13 | 55% | 25% | 0.45 | 5% | 40 | 33 | 10.0 |
| 14 | 14 | 53% | 26% | 0.49 | 5% | 55 | 29 | 7.5 |
| 15 | 15 | 55% | 22% | 0.40 | 4% | 45 | 32 | 7.5 |
| 16 | 16 | 48% | 28% | 0.58 | 7% | 270 | 5 | 7.5 |
| 17 | 17 | 52% | 26% | 0.50 | 6% | 56 | 29 | 7.5 |
| 18 | 18 | 54% | 22% | 0.41 | 4% | 53 | 30 | 7.5 |
| 19 | 19 | 53% | 25% | 0.47 | 5% | 55 | 29 | 7.5 |
| 20 | 20 | 41% | 30% | 0.73 | 12% | 40 | 32 | 7.5 |
| 21 | 21 | 57% | 24% | 0.42 | 6% | 60 | 27 | 3.0 |
| 22 | 22 | 50% | 26% | 0.52 | 3% | 40 | 33 | 11.0 |
| 23 | 23 | 57% | 28% | 0.49 | 7% | 57 | 29 | 7.5 |
| 24 | 24 | 39% | 29% | 0.74 | 9% | 30 | 10 | 7.5 |
| 25 | 25 | 52% | 25% | 0.48 | 7% | 350 | 6 | 7.5 |
| 26 | 26 | 52% | 25% | 0.48 | 7% | 45 | 23 | 7.5 |
| 27 | 27 | 37% | 24% | 0.65 | 5% | 55 | 30 | 7.5 |
| 28 | 28 | 50% | 38% | 0.74 | 6% | 47 | 33 | 7.5 |
| 29 | 29 | 46% | 35% | 0.76 | 8% | 50 | 30 | 7.5 |
| 30 | 30 | 44% | 46% | 1.05 | 7% | 50 | 30 | 7.5 |
| 31 | 31 | 44% | 34% | 0.77 | 6% | 100 | 6 | 7.5 |

Example 1

An electrophotographic apparatus for evaluation was obtained by modifying an HP printer (HP LaserJet Pro M506dn) to increase the process speed by a factor of 1.3.

Further, CF287X was used as a toner cartridge, 680 g of the toner 1 was filled, and the following evaluation was performed. The evaluation results are shown in Table 7.

Evaluation 1: Evaluation of Rub Fixing Performance

Evaluation of the rub fixing performance was performed in a low-temperature and low-humidity environment (temperature 15° C., relative humidity 10%), which is an environment that is severe for evaluating low-temperature fixability. This is because the temperature rise rate is low in a low-temperature and low-humidity environment of the fixing device.

The evaluation was performed by using rough paper, COTTON BOND LIGHT COCKLE (basis weight 90 $g/m^2$) as the evaluation paper, and arranging an image having a halftone portion at the rear end with respect to the paper conveying direction. The output was performed so that the image density of the halftone portion became 0.70. Next, the obtained image was rubbed back and forth five times with a silbon paper under a load of 4.9 kPa, and the image density reduction ratio before and after rubbing was measured. The lower the density reduction rate, the better the fixing performance. The criteria for determining the rub fixing property are presented hereinbelow. The evaluation results are shown in Table 7.

The image density was measured using a Macbeth reflection densitometer (manufactured by Macbeth Co.).

A: density reduction rate less than 5.0%

B: density reduction rate 5.0% or more and less than 10.0%

C: density reduction rate 10.0% or more and less than 15.0%

D: density reduction rate 15.0% or more

Evaluation 2: Evaluation of Fogging

Assuming a long-term durability test, a horizontal line pattern with a print percentage of 1% was set as 2 prints/job, and the next job was started after the machine was stopped once between jobs. In this mode, an image output test was performed on a total of 20000 prints, after which a white image was outputted, and the reflectance thereof was measured using REFLECTMETER MODEL TC-6DS manufactured by Tokyo Denshoku Co., Ltd. The durability was evaluated in a severe high-temperature and high-humidity environment (40.0° C./80% Rh) in which an external additive is likely to be embedded.

Meanwhile, the reflectance of the transfer paper before the formation of the white image was measured in the same manner. Fogging was calculated from the reflectance before and after outputting the white image using the following equation.

Fogging (reflectance) (%)=reflectance of transfer paper (%)−reflectance of white image (%).

Evaluation criteria for fogging are presented hereinbelow. The evaluation results are shown in Table 7.

A: less than 1.0%
B: 1.0% or more and less than 1.5%
C: 1.5% or more and less than 2.5%
D: 2.5% or more Examples 2 to 26 and Comparative Examples 1 to 5

Table 7 shows the results of evaluation of toners 2 to 26 corresponding to Examples 2 to 26 and toners 27 to 31 corresponding to Comparative Examples 1 to 5 that was performed in the same manner as in Example 1.

TABLE 7

| Example | Toner | Rub fixing performance | | Fogging | |
|---|---|---|---|---|---|
| No. | No. | Rank | Value | Rank | Value |
| 1 | 1 | A | 3.5 | A | 0.7 |
| 2 | 2 | B | 5.0 | A | 0.4 |
| 3 | 3 | A | 3.3 | A | 0.8 |
| 4 | 4 | A | 3.1 | B | 1.0 |
| 5 | 5 | B | 6.5 | A | 0.8 |
| 6 | 6 | A | 4.2 | A | 0.7 |
| 7 | 7 | A | 2.0 | A | 0.5 |
| 8 | 8 | A | 4.0 | A | 0.7 |
| 9 | 9 | C | 10.0 | A | 0.9 |
| 10 | 10 | C | 11.0 | A | 0.4 |
| 11 | 11 | A | 1.7 | B | 1.0 |
| 12 | 12 | A | 3.6 | A | 0.6 |
| 13 | 13 | B | 7.0 | A | 0.8 |
| 14 | 14 | B | 6.3 | A | 0.6 |
| 15 | 15 | A | 2.5 | B | 1.0 |
| 16 | 16 | C | 12.0 | A | 0.7 |
| 17 | 17 | A | 3.7 | A | 0.7 |
| 18 | 18 | A | 3.9 | A | 0.7 |
| 19 | 19 | A | 3.6 | A | 0.7 |
| 20 | 20 | C | 13.0 | B | 1.2 |
| 21 | 21 | C | 14.0 | A | 0.6 |
| 22 | 22 | C | 12.0 | A | 0.8 |
| 23 | 23 | C | 11.0 | B | 1.1 |
| 24 | 24 | C | 14.0 | B | 1.2 |
| 25 | 25 | C | 13.0 | A | 0.7 |
| 26 | 26 | C | 11.0 | B | 1.0 |
| Comparative Example 1 | 27 | C | 11.5 | C | 2.4 |
| Comparative Example 2 | 28 | C | 14.5 | C | 2.2 |
| Comparative Example 3 | 29 | C | 12.2 | C | 1.9 |
| Comparative Example 4 | 30 | D | 15.5 | D | 2.6 |
| Comparative Example 5 | 31 | D | 15.2 | C | 2.4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-090557, filed May 13, 2019, which is hereby incorporated by reference herein in its entirety.

What is claimed is:

1. A toner, comprising:

a toner particle including a binder resin and a magnetic body, wherein

A2/A1 is from 0 to 0.75 where in cross-sectional observation of the toner with a transmission electron microscope A1 is an area percentage occupied by the magnetic body in a region of 200 nm or less from a contour of a cross section of the toner particle to a centroid of the cross section and is 38 to 85%, and A2 is an area percentage occupied by the magnetic body in a region of from 200 to 400 nm from the contour of the cross section of the toner particle to the centroid of the cross section and is 0 to 37%.

2. The toner according to claim 1, wherein A3 is 10% or less where A3 is an area percentage occupied by the magnetic body in a region of 400 nm or more from the contour of the cross section of the toner particle to the centroid of the cross section.

3. The toner according to claim 1, wherein a number-average particle diameter of the toner is 4.0 to 10.0 μm.

4. The toner according to claim 1, wherein a number-average particle diameter of primary particles of the magnetic body is 100 to 300 nm.

5. The toner according to claim 1, wherein the magnetic body includes a hydrophobed magnetic body A, the binder resin includes a resin B, the toner particle includes a resin C, and $b<a<c$ where a ($MPa^{1/2}$) is a dipole interaction term of Hansen solubility parameter of the hydrophobed magnetic body A, b ($MPa^{1/2}$) is a dipole interaction term of Hansen solubility parameter of the resin B, and c ($MPa^{1/2}$) is a dipole interaction term of Hansen solubility parameter of the resin C.

6. The toner according to claim 5, wherein b is 1.0 to 3.0.

7. The toner according to claim 5, wherein resin B is a vinyl resin.

8. The toner according to claim 5, wherein c is 4.0 to 8.0.

9. The toner according to claim 5, wherein resin C is an amorphous polyester that includes a structure in which isosorbide is condensed.

10. The toner according to claim 1, wherein the toner particle includes a crystalline material, and in cross-sectional observation of the toner with a transmission electron microscope, a number-average diameter of domains of the crystalline material is from 20 nm to 300 nm in a region of 200 to 400 nm from the contour of the cross section of the toner particle to the centroid of the cross section, and the number of domains in the region is 10 to 100.

11. The toner according to claim 10, wherein the crystalline material includes at least one member selected from the group consisting of a hydrocarbon wax, an ester wax and a crystalline polyester.

12. The toner according to claim 1, wherein the toner further comprises an external additive.

13. The toner according to claim 1, wherein the toner particle is a suspension polymerization toner particle.

* * * * *